United States Patent [19]

Taniwaki

[11] 4,138,173

[45] Feb. 6, 1979

[54] DEVICE FOR ANCHORING MOVABLE BOX-SHAPED SHELF ASSEMBLY

[75] Inventor: Genshi Taniwaki, Kumamoto, Japan

[73] Assignee: Kongo Co., Ltd., Kumamoto, Japan

[21] Appl. No.: 742,357

[22] Filed: Nov. 16, 1976

[30] Foreign Application Priority Data

Mar. 23, 1976 [JP] Japan ..... 51-6177[U]

[51] Int. Cl.[2] ..... A47B 87/00

[52] U.S. Cl. ..... 312/198; 312/200; 292/170

[58] Field of Search ..... 312/198, 333, 201, 200; 292/170, 187, 189

[56] References Cited

U.S. PATENT DOCUMENTS

| | | | |
|---|---|---|---|
| 620,468 | 2/1899 | Lowery et al. | 292/170 |
| 725,577 | 4/1903 | Miller | 292/170 |
| 995,232 | 6/1911 | Edgar, Sr. | 292/189 |
| 1,310,030 | 7/1919 | Moynihan | 292/189 |
| 2,207,569 | 7/1940 | Wild | 292/170 |
| 2,772,639 | 12/1956 | Ingold | 312/201 |
| 3,640,595 | 2/1972 | Staller et al. | 312/200 |
| 3,919,866 | 11/1975 | Lipschutz | 292/170 |
| 3,923,354 | 12/1975 | Young | 312/198 |
| 3,944,309 | 3/1976 | Taniwaki | 312/198 |
| 4,017,131 | 4/1977 | Camenisch | 312/198 |

FOREIGN PATENT DOCUMENTS

| | | | |
|---|---|---|---|
| 590335 | 7/1947 | United Kingdom | 292/170 |
| 718360 | 11/1954 | United Kingdom | 312/198 |

*Primary Examiner*—Victor N. Sakran

*Attorney, Agent, or Firm*—Armstrong, Nikaido, Marmelstein & Kubovcik

[57] ABSTRACT

Disclosed is a device for anchoring a movable box-shaped shelf assembly of the type wherein the assembly is supported by wheels which in turn ride on parallel rails laid on a floor and a handwheel is attached to one side wall of the assembly and is drivingly coupled through a reduction gear to a shaft of the wheels so that upon rotation of the handwheel, the shelf assembly may be moved along the rails in either direction. The anchoring device comprises a toothed locking wheel carried by a shaft of the handwheel for rotation therewith, an operating member which has its lower end terminated into a locking pawl and is disposed for vertical movement so that the locking pawl may drop into a space between teeth of the toothed locking wheel by its own weight, and a locking knob having its shaft extended through the side wall, the inner end of the shaft terminated into a wedge which is slidably fitted into a guide opening formed through the operating member with the hypotenuse surface of the wedge made into slidable contact with the upper end of the guide opening so that the reciprocal slidable movement of the wedge in the direction perpendicular to the axis of the operating member causes the reciprocal vertical movement of the latter and when the operating member is lowered, its locking pawl engages with the teeth of the toothed locking wheel to lock it securely against rotation and consequently the shelf assembly may be securely anchored at rest on the rails.

6 Claims, 5 Drawing Figures

DEVICE FOR ANCHORING MOVABLE BOX-SHAPED SHELF ASSEMBLY

BACKGROUND OF THE INVENTION

The present invention relates to a device for anchoring a movable, box-shaped shelf assembly in a desired position.

Well known in the art and widely used in various fields in order to attain a maximum use of a given space is a movable shelf system wherein a plurality of wheeled, shelf assemblies ride on parallel rails laid on a floor and each shelf assembly is moved on the rails when one turns a handwheel which is attached to one side of the shelf assembly and is drivingly coupled through a suitable reduction gear to a shaft of wheels.

This system has advantages in that even a heavy shelf assembly loaded with many articles may be easily moved by manual operation away from the adjacent shelf assembly so that a space may be provided between the two shelf assemblies for placing articles on or taking them from shelves.

However, there has been a danger that a shelf assembly starts running by itself by accident when the rails are inclined even at very little angle or by the collision of a running shelf assembly against the assembly at rest. And if this happens, one who is in the space between the adjacent shelf assemblies for placing articles on or taking them from the shelves is sandwiched between the assemblies and is seriously injuried. Even when no one is in the space between the assemblies, the collision of them results in scattering and falling of particles placed on the shelves.

SUMMARY OF THE INVENTION

One of the objects of the present invention is therefore to provide a device for securely anchoring a movable shelf assembly at rest in a desired position, thereby preventing free running of the movable shelf assembly which would cause serious accidents as described above.

Another object of the present invention is to provide an anchoring device which is very simple in construction and inexpensive to fabricate yet highly reliable and dependable in operation.

Briefly stated, to the above and other ends, the present invention provides a device for anchoring a movable shelf assembly comprising a shelf assembly supported on wheels which ride on rails laid on a floor in parallel with each other; a manually operable handwheel carried at the outer end of a shaft extended through a side wall of said shelf assembly; a power transmission mechanism including reduction gear means for transmitting the rotation of said shaft of said handwheel to a shaft of said wheels; a toothed locking wheel carried by said shaft of said handwheel for rotation in unison therewith; locking means disposed for vertical movement and capable of dropping by its own weight into a space between teeth of said toothed locking wheel; an operating member having its lower end securely connected to the upper end of said locking means and disposed for vertical movement; wedge means slidably fitted into a guide hole formed through said operating member, said wedge means being reciprocably and slidably movable in the direction perpendicular to the axis of said operating member so that the latter is caused to move vertically; and a locking knob for sliding said wedge means securely fixed to said wedge means and extended through said side wall outwardly thereof, whereby when said locking knob is pushed or pulled, said locking member drops into the space between the teeth of the toothed locking wheel, thereby locking it against rotation and consequently securely anchoring the shelf assembly whereas when the locking knob is pulled or pushed, said locking member is released from the locking wheel to permit the movement of the shelf assembly.

The above and other objects, features and advantages of the present invention will become more apparent from the following description of preferred embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

Figure 1:
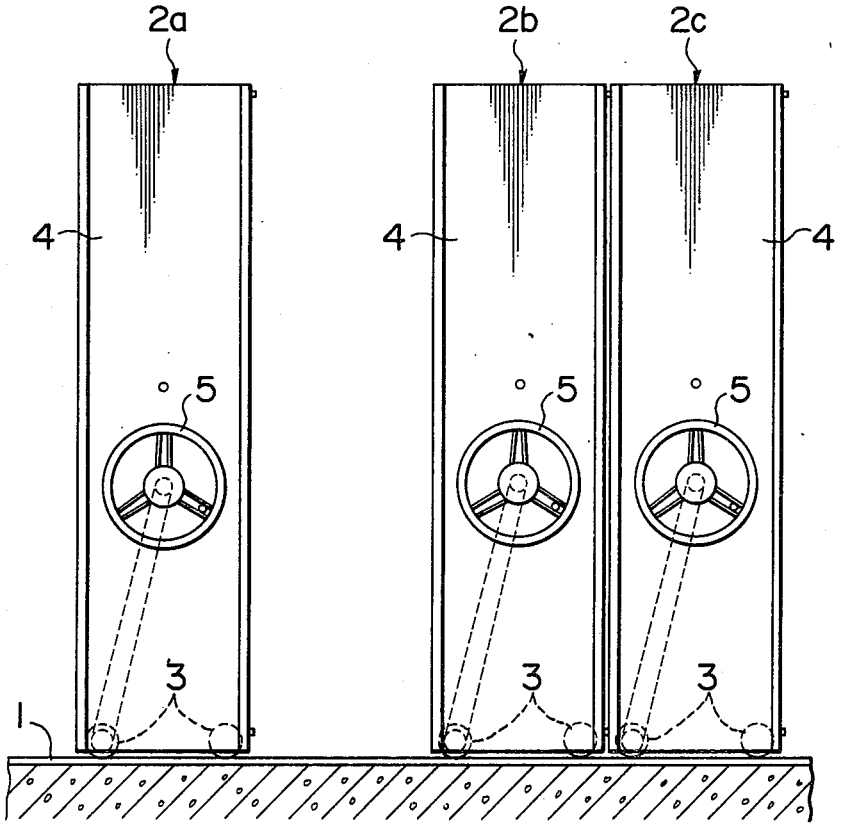
FIG. 1 shows a movable shelf storage system to which is applied the present invention.

In FIG. 1 there are shown three movable boxshaped shelf assemblies 2*a*, 2*b* and 2*c* to which are applied the present invention and which are substantially similar in construction so that the description of one 2*a* will suffice. The shelf assembly 2*a* is supported on wheels 3 which ride on rails 1 laid on a floor, and a handwheel 5 is attached to one side wall 4 of the shelf assembly 2*a* at such a height that it may be easily operated by one in a standing position. The handwheel 5 is drivingly coupled through a reduction gear (not shown) to a shaft of a pair of wheels 3 so that upon rotation of the handwheel 5, the shelf assembly 2*a* may be moved in either direction on the rails 1.

Figure 2:
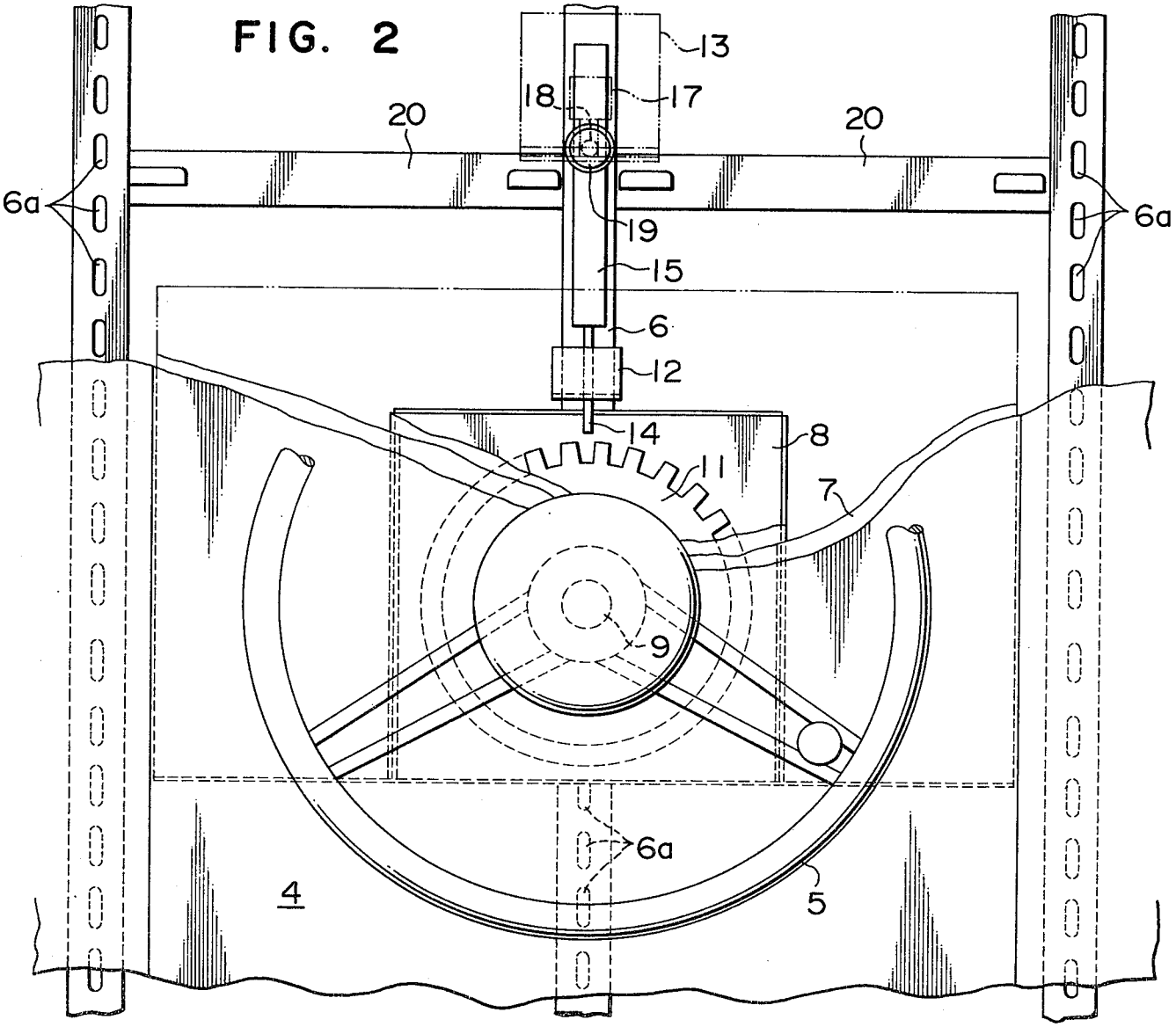
FIG. 2 is a fragmentary front view, on enlarged scale and with a part broken of a movable shelf assembly shown in FIG. 1.
Figure 3:
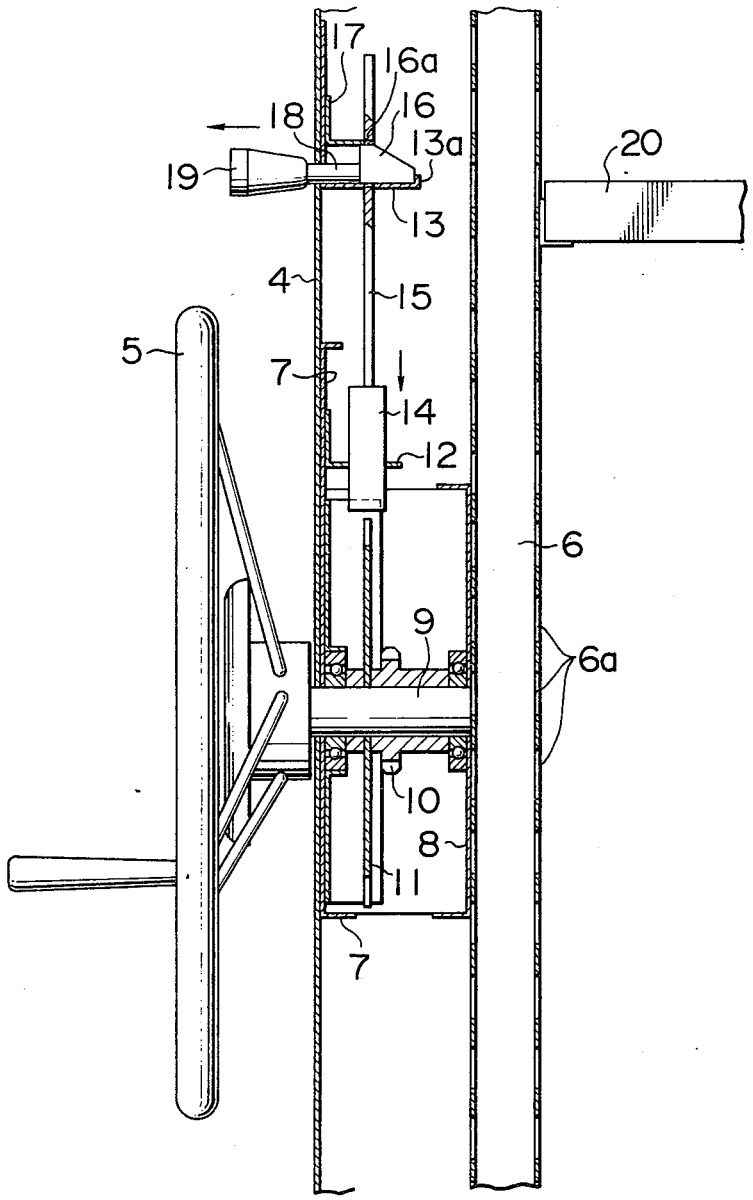
FIG. 3 is a side view of FIG. 2.

First Embodiment, FIGS. 2 and 3

Prior to the description of the preferred embodiments of the present invention, two directions referred in this specification are defined as follows:

Longitudinal direction: the direction vertical to FIG. 3, and

Lateral direction: the direction vertical to FIG. 2.

As best shown in FIG. 3, the side wall 4 is spaced apart from columns 6 with slots 6*a* and a shelf 20, and a first reinforcing member 7 is securely attached the side wall 4 while a second reinforcing member 8 smaller in area than the first reinforcing member is securely attached to the center column 6 in opposed relation with the first reinforcing member 7. A shaft 9 of the handwheel 5 is rotatably supported by bearings attached to the first and second reinforcing members 7 and 8 and has a driving sprocket 10 and a toothed locking wheel 11 both of which are formed integral with the shaft 9. The driving sprocket 10 is drivingly coupled with an endless chain (not shown) to a driven sprocket (not shown) carried by the wheel shaft. The toothed wheel 11 has a greater diameter than the driving sprocket 10.

A first angle 12 is attached to the first reinforcing member 7 and is spaced apart upwardly from the toothed wheel 11 by a suitable distance, and a second angle 13 is attached to the side wall 4 and is spaced upwardly from the first angle 12 by a suitable distance. A third angle 17 is securely attached to the second angle 13 in such a way that the horizontal legs thereof may be spaced apart from each other by a suitable distance as will be described in detail hereinafter.

An operating or connecting member 15 has its lower end terminated into a locking pawl 14 for engagement with teeth of the toothed wheel 11. The upper portion of the operating member 15 is guided for vertical slidable movement by a guide hole formed through the horizontal leg of the second angle 13 while the locking pawl 14 is slidably fitted into and guided by a guide hole formed through the horizontal leg of the first angle 12 for vertical slidable movement in unison with the operating member 15.

An operating or locking knob 19 is securely attached to the outer end of a shaft 18 which is extended through the side wall 4 and which has its inner end securely fixed to the vertical side face of a wedge 16. The wedge 16 is interposed between the horizontal legs of the second and third angles 13 and 17 for slidable movement in the lateral direction. Therefore the space between the horizontal legs must be suitably determined so as to enable them to smoothly guide the wedge 16. The wedge 16 is fitted into an engaging or guide hole formed through the operating member 15 with the hypotenuse surface of the wedge 16 normally slidably engaged with the upper side of the guide hole so that the slidable movement of the wedge 16 in the lateral direction causes the vertical movement of the operating member 15 and hence the locking pawl 14. In order to ensure a smooth guide of the wedge 16, the inner end **13*a* and sides of the horizontal leg of the second angle 13** are bent upright.

When the operating knob 19 is pushed in the direction opposite to the direction indicated by an arrow in FIG. 3, the upper side of the guide hole of the operating member 15 is caused to ride upwardly over the hypotenuse surface of the wedge to the vertex **16*a* so that the operating member 15 is brought to the upper end of its stroke and consequently the locking pawl 14 is moved away from the path of the teeth of the toothed wheel 11. Therefore one may manually operate or turn the handwheel 5 to move the shelf assembly 2*a* along the rails 1** in either longitudinal direction.

When it is desired to anchor the shelf assembly **2*a* securely in position, one pulls the operating knob 19 in the direction indicated by the arrow shown in FIG. 3 so that the upper side of the guide hole of the operating member is caused to slide downwardly over the hypotenuse surface of the wedge 16 so that the operating member 15 is displaced downwardly and consequently the locking pawl 14 drops by its own weight and is arrested in the space between the teeth of the toothed wheel 11. As a consequence the toothed wheel 11 is locked so that one cannot turn the wheel 5. In other words, the shelf assembly 2*a* is securely anchored in position even when the rails 1** are slightly inclined. Thus, an erroneous free movement of the movable shelf assembly may be positively prevented so that the accidents such as collisions between the adjacent shelf assemblies may be eliminated.

When one pulls the operating knob 19 to lock the handwheel 5, the locking pawl 14 would not engage with the teeth of the toothed wheel 11 because the locking pawl 14 is in engagement with the outer end of a teeth of the toothed wheel 11. One remedy is to rotate the wheel 5 through a very small angle so that the locking pawl 14 is moved away from the outer end of the tooth and is dropped and arrested in the space between the teeth. However, in practice, when the movable shelf assembly **2*a* starts to move even a very small distance, the driving sprocket 10 and hence the locking wheel 11 are caused to rotate so that the locking pawl 14 is automatically advanced into the space between the teeth to lock the toothed wheel 11 and hence the handwheel 5**. Thus, fail-safe locking operation may be ensured.

Figure 4:
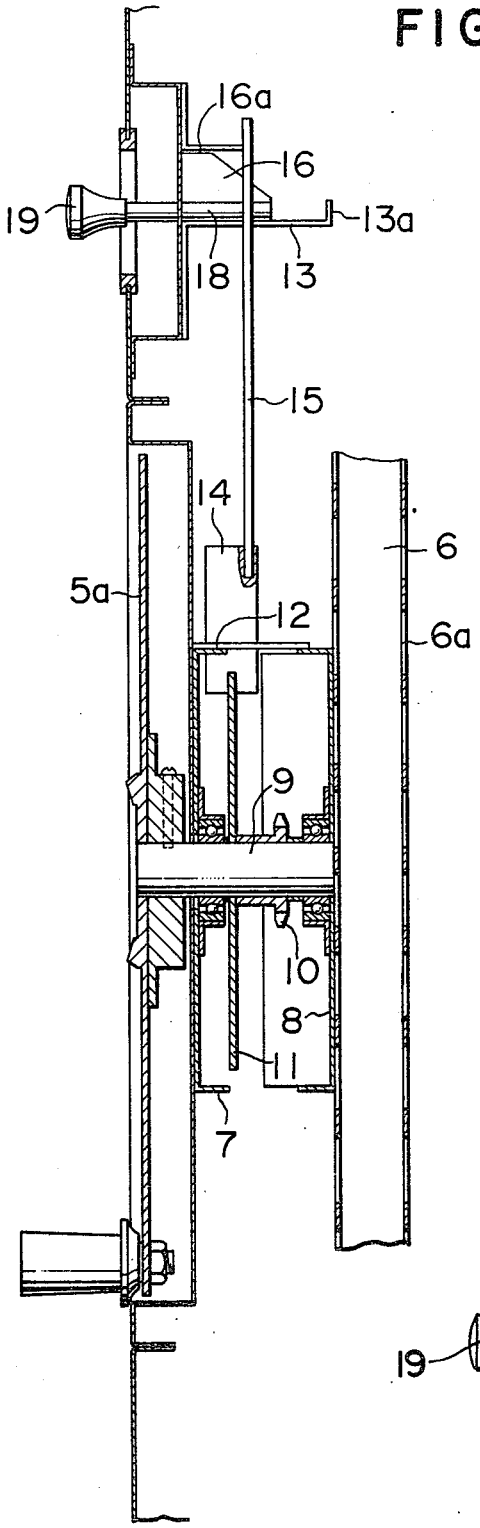
FIG. 4 is a side view of a modification of the device shown in FIGS. 2 and 3.

Modification, FIG. 4

The modification shown in FIG. 4 is substantially similar in construction to the first embodiment described above in conjunction with FIGS. 2 and 3 except that instead of the handwheel 5, an operating or driving disk **5*a* is attached to the outer end of the shaft 9. It should be noted that the outer surface of the driving disk 5*a* is substantially coplanar with the outer surface of the side wall 4**. The mode of operation is substantially similar to that of the first embodiment so that no further description will be made.

According to the present invention, the operating knob may be located outside of the operating range of the handwheel or driving disk so that the operations of both the handwheel or driving disk and operating knob may be much facilitated.

Figure 5:
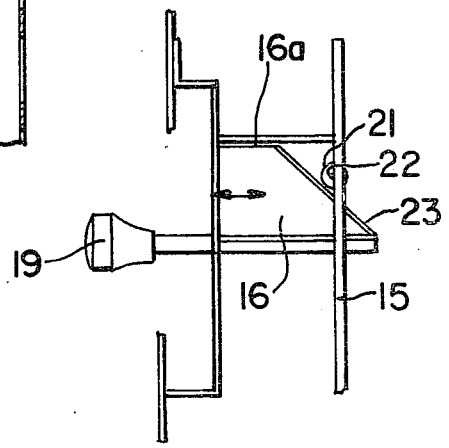
FIG. 5 is a side view of a modification of the device shown in FIGS. 2-4.

So far the wedge 16 has been described and shown as having the hypotenuse surface downwardly inclined laterally inwardly, but it will be understood that the hypotenuse surface may be downwardly inclined laterally outwardly. Furthermore, the operating member 15 may be provided with rollers 21 which are carried by a shaft 22 disposed in parallel with the upper side of the guide hole of the operating member 15 and freely ride on the hypotenuse surface of the wedge 16 so that smoother slidable movement thereof may be provided as seen in FIG. 5. Alternatively, a lubricating plate 23 made of nylon, Teflon or the like may be attached to the hypotenuse surface of the wedge 16 as also seen in FIG. 5.

What is claimed is:

1. A device for anchoring a movable shelf assembly comprising a shelf assembly supported on wheels which ride on spaced apart parallel rails laid on a floor;

a manually operable drive means carried at the outer end of a shaft extended through a side wall of said shelf assembly;

a power transmission mechanism including reduction gear means for transmitting the rotation of said shaft of said drive means to a shaft of said wheels;

a toothed locking wheel carried by said shaft of said drive means for rotation in unison therewith;

locking means disposed for vertical movement and capable of dropping by its own weight into a space between teeth of said toothed locking wheel;

an operating member having its lower end securely connected to the upper end of said locking means and disposed for vertical movement;

wedge means slidably fitted into a guide hole formed through said operating member, said wedge means being reciprocably and slidably movable in a direction perpendicular to the axis of said operating member so that the latter is caused to move vertically; and a locking knob for sliding said wedge means securely fixed to said wedge means and extended through said side wall outwardly thereof;

wherein said wedge means includes a hypotenuse surface, said hypotenuse surface being directed upwardly and inclined downwardly, and a vertex surface, said vertex surface being directed upwardly and extending horizontally, wherein when said locking knob is in one position for causing said wedge member to hold said operating member and said locking means in an unlocked position, said upwardly directed horizontally extending vertex surface is brought into contact with the upper side of said guide hole, and when said locking knob is in another position for causing said wedge member to allow said operating member and said locking means to drop into a locking position, said upwardly directed, downwardly inclined surface is brought into slidable contact with the upper side of said guide hole of said operating member.

2. A device for anchoring a movable shelf assembly as set forth in claim 1 wherein said wedge means upwardly directed, downwardly inclined surface is directed laterally inwardly.

3. A device for anchoring a movable shelf assembly as set forth in claim 1 wherein said operating member is provided with at least one for rolling contact with the hypotenuse surface of said wedge means, said roller being carried by a shaft disposed in said guide opening of said operating member in parallel with the upper side of said guide hole.

4. A device for anchoring a movable shelf assembly as set forth in claim 1 wherein a solid lubricating member made of nylon, Teflon or the like is securely attached on the hypotenuse surface of said wedge means.

5. A device for anchoring a movable shelf assembly as set forth in claim 1, wherein said manually operable drive means comprises a handwheel.

6. A device for anchoring a movable shelf assembly as set forth in claim 1, wherein said manually operable drive means comprises a driving disk, said driving disk being coplanar with the outer surface of said side wall.

* * * * *

UNITED STATES PATENT AND TRADEMARK OFFICE

CERTIFICATE OF CORRECTION

PATENT NO. : 4,138,173

DATED : February 6, 1979

INVENTOR(S) : Taniwaki

It is certified that error appears in the above-identified patent and that said Letters Patent are hereby corrected as shown below:

On the cover page, Item [30], Priority data should read:

Feb. 23, 1976 Japan 51-20990

Signed and Sealed this

*Twenty-fifth* Day of *September 1979*

[SEAL]

*Attest:*

*Attesting Officer*

LUTRELLE F. PARKER

*Acting Commissioner of Patents and Trademarks*